US010434802B2

(12) United States Patent
Kasai

(10) Patent No.: US 10,434,802 B2
(45) Date of Patent: Oct. 8, 2019

(54) PRINTING APPARATUS AND CONTROL METHOD OF PRINTING APPARATUS

(71) Applicant: SEIKO EPSON CORPORATION, Tokyo (JP)

(72) Inventor: Yuichiro Kasai, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/116,157

(22) Filed: Aug. 29, 2018

(65) Prior Publication Data

US 2019/0061388 A1 Feb. 28, 2019

(30) Foreign Application Priority Data

Aug. 30, 2017 (JP) ..... 2017-165171

(51) Int. Cl.

| | |
|---|---|
| ***B41J 13/00*** | (2006.01) |
| ***B41J 3/407*** | (2006.01) |
| ***B41J 11/00*** | (2006.01) |
| ***B41J 11/06*** | (2006.01) |

(52) U.S. Cl.

CPC ..... *B41J 13/0009* (2013.01); *B41J 3/4075* (2013.01); *B41J 11/0085* (2013.01); *B41J 11/0095* (2013.01); *B41J 11/06* (2013.01)

(58) Field of Classification Search

CPC .... B41J 13/0009; B41J 11/0085; B41J 11/06; B41J 11/0095; B41J 3/4075

See application file for complete search history.

(56) References Cited

U.S. PATENT DOCUMENTS

2006/0151118 A1* 7/2006 Murata ..... B41J 3/4075 156/379

FOREIGN PATENT DOCUMENTS

| | | |
|---|---|---|
| JP | 04-45754 Y | 4/1992 |
| JP | 07-101624 A | 4/1995 |
| JP | 2007-62209 A | 3/2007 |

OTHER PUBLICATIONS

IP.com search (Year: 2019).*

* cited by examiner

*Primary Examiner* — Lisa Solomon
(74) *Attorney, Agent, or Firm* — Workman Nydegger

(57) ABSTRACT

A label printer includes a print head, a transport roller disposed on an upstream side of the print head, a photosensor configured to detect a rear end of a label paper on an upstream side of the transport roller, and a control unit, and is configured to be capable of using a peeling unit including a peeling roller, in which the control unit causes the transport roller to stop transport when the rear end of the label paper comes off from the transport roller in a case where the photosensor detects the rear end of the label paper in a normal printing mode in which the peeling unit is not used, and causes the peeling roller to transport the mount after the rear end of the label paper comes off from the transport roller in a case where the photosensor detects the rear end of the label paper in a peeling mode in which the peeling unit is used.

7 Claims, 7 Drawing Sheets

PRINTING APPARATUS AND CONTROL METHOD OF PRINTING APPARATUS

CROSS REFERENCES TO RELATED APPLICATIONS

This application claims priority based on Japanese Patent Application No. 2017-165171, filed in the Japanese Patent Office on Aug. 30, 2017, the entire contents of which are incorporated herein by reference.

BACKGROUND

1. Technical Field

The present invention relates to a printing apparatus and a control method of the printing apparatus.

2. Related Art

As an existing printing apparatus, a label printer has been known that transports a label paper with labels affixed to a long mount and prints on each of the labels (see, for example, JP-A-7-101624). A printer disclosed in JP-A-7-101624 is configured to be capable of using a peeling device which peels the label after printing from the mount and supplies the peeled label.

As disclosed in JP-A-7-101624, the label paper is supplied as a roll paper that is wound in a roll form in many cases. A printer which prints on the label paper of this kind generally stops when a rear end of the label paper is detected, and the label paper is replaced by a user in this state. In this case, the label paper is replaced before printing on a label in the vicinity of the rear end of the label paper in some cases, and a method of more effectively utilizing the label has been desired.

SUMMARY

An advantage of some aspects of the invention is to effectively utilize a label which is located in the vicinity of a rear end of a label paper in a printing apparatus which prints on the label paper.

A printing apparatus according to an aspect of the invention includes: a print head configured to print on a label paper with a label affixed to a mount; a first transporter configured to transport the label paper on an upstream side of the print head in a transport path of the label paper and; a paper detector configured to detect a rear end of the label paper on an upstream side of the first transporter in the transport path of the label paper; a processor configured to control the print head and the first transporter; and a peeler configured to peel the label from the mount and include a second transporter transporting the mount. The processor causes the first transporter to stop transport when the rear end of the label paper comes off from the first transporter in a case where the paper detector detects the rear end of the label paper in a normal printing mode in which the peeler is not used, and causes the second transporter to transport the mount after the rear end of the label paper comes off from the first transporter in a case where the paper detector detects the rear end of the label paper in a peeling mode in which the peeler is used.

According to this configuration, when the rear end of the label paper is detected, the label paper is transported until the rear end of the label paper comes off from the first transporter when the peeler is not used, and the mount is transported by the second transporter of the peeler even after the rear end of the label paper comes off from the first transporter when the peeler is used. As a result, when the peeler is used, it is possible to print on the label in the vicinity of the rear end of the label paper while transporting the label paper by the second transporter, and it is possible to effectively use the label. In addition, when the peeler is not used, the label paper comes off from the first transporter, thereby making it possible to facilitate the replacement work and improve the working efficiency.

In addition, in the above printing apparatus, it is preferable that a configuration be such that a suction platen for adsorbing the label paper is included on a platen surface facing the print head, and the processor causes the second transporter to transport the label paper along the platen surface and causes the print head to print on the label, after the rear end of the label paper is detected by the paper detector in the peeling mode.

According to this configuration, when the label paper is transported by the second transporter after the rear end of the label paper comes off from the first transporter, the label paper can be stabilized by the suction platen. For this reason, it is possible to reliably print on the label in the vicinity of the rear end of the label paper and to effectively use the label.

In addition, in the above printing apparatus, when printing on the label by the print head after the rear end of the label paper has come off from the first transporter in the peeling mode, it is preferable that a configuration be such that the processor makes a transport speed by the second transporter lower than the transport speed by the first transporter when printing on the label by the print head in the normal printing mode.

According to this configuration, after the rear end of the label paper has come off from the first transporter, the label paper can be stably transported by the second transporter.

In addition, in the above printing apparatus, when the rear end of the label paper is detected by the paper detector in the normal printing mode, it is preferable that a configuration be such that the processor performs printing on the label that is the last label by the print head, then causes the first transporter to discharge the label paper, and thereafter causes the first transporter to stop transport.

According to this configuration, it is possible to effectively use the last label on which printing can be performed on the label paper.

In addition, in the above printing apparatus, it is preferable that a configuration be such that a memory is included that stores a setting state of an operation mode of an operation to be executed by the processor, and the processor switches between the normal printing mode and the peeling mode based on the setting state stored in the memory.

According to this configuration, by storing the setting state in the memory, it is possible to operate the printing apparatus in an arbitrary operation mode.

In addition, in the above printing apparatus, it is preferable that a configuration be such that the peeler is configured so as to be detachable from a main body of the printing apparatus, a peeler detector that detects whether or not the peeler is attached to the main body is included, and the processor switches between the normal printing mode and the peeling mode based on a result of detection by the peeling unit detection unit.

According to this configuration, it is possible to operate the printing apparatus in an appropriate operation mode corresponding to the attaching/detaching state of the peeler.

A control method of a printing apparatus according to an aspect of the invention is a control method of a printing apparatus that includes: a print head configured to print on a label paper with a label affixed to a mount; a first transporter configured to transport the label paper on an upstream side of the print head in a transport path of the label paper; and a paper detector configured to detect a rear end of the label paper on an upstream side of the first transporter in the transport path of the label paper; and a peeler configured to peel the label from the mount and include a second transporter transporting the mount. The control method includes: stopping transport by the first transporter when the rear end of the label paper comes off from the first transporter in a case where the paper detector detects the rear end of the label paper in a normal printing mode in which the peeler is not used; and transporting the mount by the second transporter after the rear end of the label paper comes off from the first transporter in a case where the paper detector detects the rear end of the label paper in a peeling mode in which the peeler is used.

According to this configuration, when the rear end of the label paper is detected in the printing apparatus, the label paper is transported until the rear end of the label paper comes off from the first transporter when the peeler is not used, and the mount is transported by the second transporter of the peeler even after the rear end of the label paper comes off from the first transporter when the peeler is used. As a result, when the peeler is used, it is possible to print on the label in the vicinity of the rear end of the label paper while transporting the label paper by the second transporter, and it is possible to effectively use the label. In addition, when the peeler is not used, the label paper comes off from the first transporter, thereby making it possible to facilitate the replacement work and improve the working efficiency.

The invention can be achieved in various forms other than the above-described printing apparatus and the control method of the printing apparatus. For example, it may be implemented as a program executed by a computer (or processor) to perform the above method. Further, the invention can be achieved in the form of a recording medium in which the above program is recorded, a server apparatus which distributes a program, a transmission medium which transmits the program, a data signal which embodies the program in a carrier wave, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
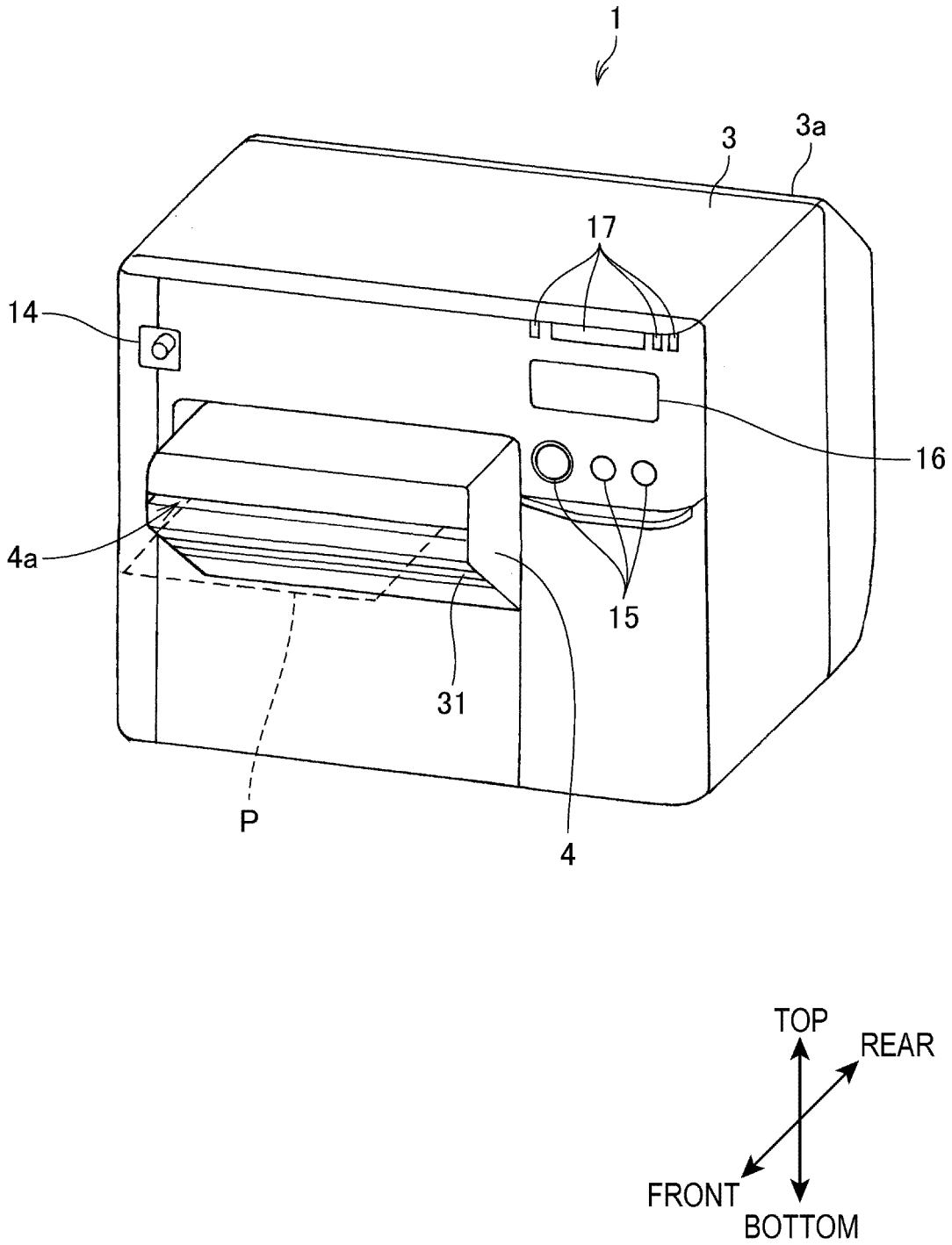
FIG. 1 is an external perspective view of a label printer according to a first embodiment.
Figure 2:
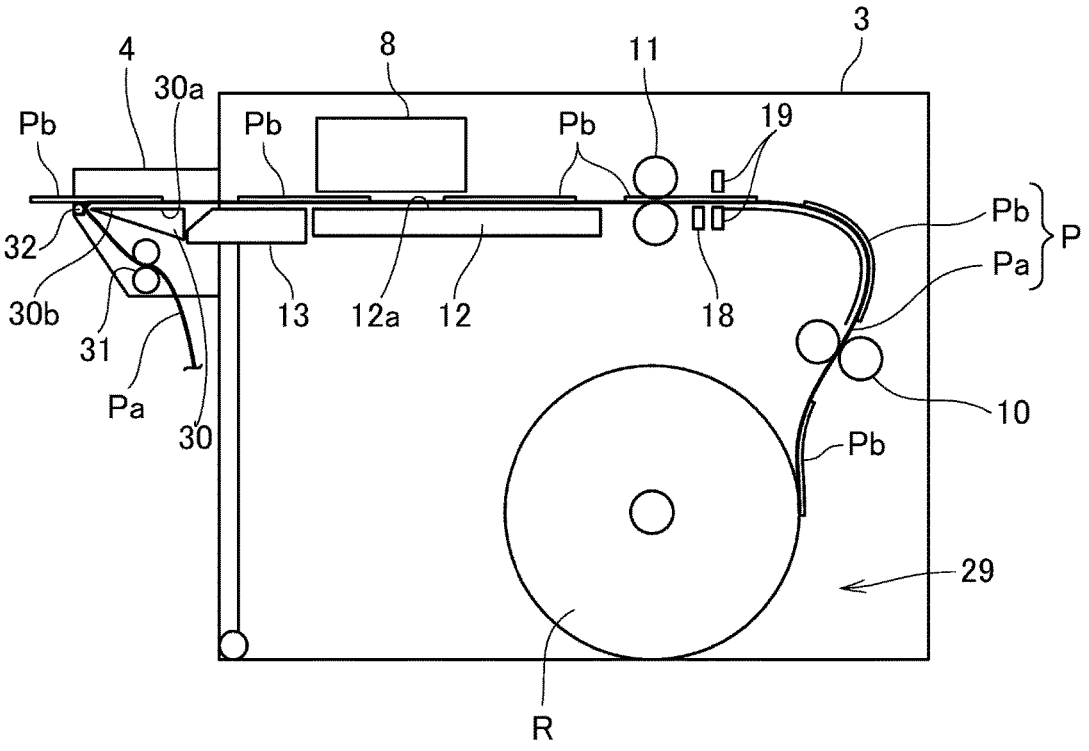
FIG. 2 is a schematic diagram illustrating a configuration of the label printer according to the first embodiment.

Hereinafter, a label printer 1 according to a first embodiment to which the invention is applied will be described with reference to the drawings. FIG. 1 is an external perspective view of the label printer 1 according to the first embodiment to which the invention is applied. FIG. 2 is a schematic diagram illustrating a configuration of the label printer 1, and illustrates an internal schematic configuration of the label printer 1.

In the following description, for convenience of description, directions of the label printer 1 will be described using "Top", "Bottom", "Front", and "Rear" illustrated in the drawing.

The label printer 1 as a printing apparatus illustrated in FIG. 1 is a printer that prints characters, images, drawings, and the like by an ink jet method on a label paper P as a print medium. The label printer 1 is connected to a host computer (not illustrated) and prints on the label paper P under the control of the host computer.

The label paper P has a mount Pa and a plurality of labels Pb. The mount Pa is a belt-like continuous paper. A peeling property is imparted to the surface of the mount Pa, and the labels Pb cut to a predetermined size are affixed at a regular interval in the longitudinal direction of the mount Pa. Materials of the mount Pa and the label Pb are not particularly limited.

On the back surface of the mount Pa, black marks (not illustrated) are provided at regular intervals corresponding to an interval between adjacent labels Pb and Pb. The black mark is used as an indicator of the leading end position of the label Pb in the longitudinal direction of the mount Pa. For example, the label printer 1 optically reads the black mark to control the printing position for printing on the label Pb. The label paper P is set in the label printer 1 as a roll paper R wound in a roll form.

The label printer 1 includes a printing unit 3 as a main body of the label printer 1 and a peeling unit 4 (a peeler). The label printer 1 according to the first embodiment has a configuration in which the peeling unit 4 is integrally fixed to the printing unit 3.

On the front surface of the peeling unit 4, a paper discharge port 4*a* is opened through which the label paper P after printing or the label Pb peeled from the label paper P is discharged.

The printing unit 3 is configured by housing a functional unit including a print head 8, which will be described later, in a substantially box-shaped case 3*a*. A power switch 14, a plurality of operation buttons 15, a display 16, and a plurality of lamps 17 are provided on the front surface of the case 3*a*.

The power switch 14 is a switch for turning on/off the power of the label printer 1. The operation button 15 is a button for accepting various operations on the label printer 1 by a user. By operating the operation button 15, a setting concerning an operation of the label printer 1, such as switching of an operation mode of the label printer 1 which will be described later, is performed. The display 16 is composed of a Liquid Crystal Display (LCD) or the like, and displays various kinds of information such as an operating state of the label printer 1. The display 16 may have a function as a touch panel for accepting user's operation. The lamp 17 has a light source such as a Light Emitting Diode (LED), turns on, turns off, flashes, or the like in response to the operating state of the label printer 1 or the like, and functions as an indicator.

On the basis of a command and print data transmitted from the host computer (not illustrated), the printing unit 3 prints on each label Pb of the label paper P by each of the functional units including the print head 8 (FIG. 2) housed in the case 3*a*. The printing unit 3 transports the label paper P after printing forward.

The peeling unit 4 is attached to the front surface of the printing unit 3. The peeling unit 4 is a device that performs a process of peeling the label Pb from the mount Pa with respect to the label paper P on which printing is performed by the printing unit 3, and is a so-called peeler.

The label printer 1 can be executed by switching between the operation using the peeling unit 4 and the operation without using the peeling unit 4. In other words, after printing on the label Pb is performed by the printing unit 3, an operation of peeling the label Pb from the mount Pa by the peeling unit 4 and an operation of discharging the label paper P from the paper discharge port 4*a* without peeling off the label Pb can be carried out in a switching manner.

More specifically, the label printer 1 has two operation modes that are a normal printing mode and a peeling mode, and can switch between the two operation modes.

The normal printing mode is an operation mode in which peeling by the peeling unit 4 is not performed. In the normal printing mode, the label printer 1 continuously prints on the plurality of labels Pb by the printing unit 3, and discharges the label paper P from the paper discharge port 4*a* in a state where the labels Pb after printing are affixed to the mount Pa.

The peeling mode is an operation mode in which peeling by the peeling unit 4 is performed. In the peeling mode, the label printer 1 peels the label Pb on which printing is performed by the printing unit 3 from the mount Pa by the peeling unit 4 and discharges the label Pb from the paper discharge port 4*a*.

In a state in which the leading end of the label Pb protrudes from the paper discharge port 4*a*, the label printer 1 stops the transport of the label paper P, and when the user removes the label Pb protruding in the paper discharge port 4*a*, the label printer 1 transports the label paper P and causes the next label Pb to protrude from the paper discharge port 4*a*.

In this manner, in the peeling mode, since the label Pb is intermittently protruded from the paper discharge port 4*a*, the printing unit 3 and the peeling unit 4 intermittently transport the label paper P. The printing unit 3 intermittently executes printing on the label Pb in accordance with timing at which the label paper P is transported. In the normal printing mode, since the label paper P is continuously transported and printing is performed, the normal printing mode may be called a continuous mode.

Figure 3:
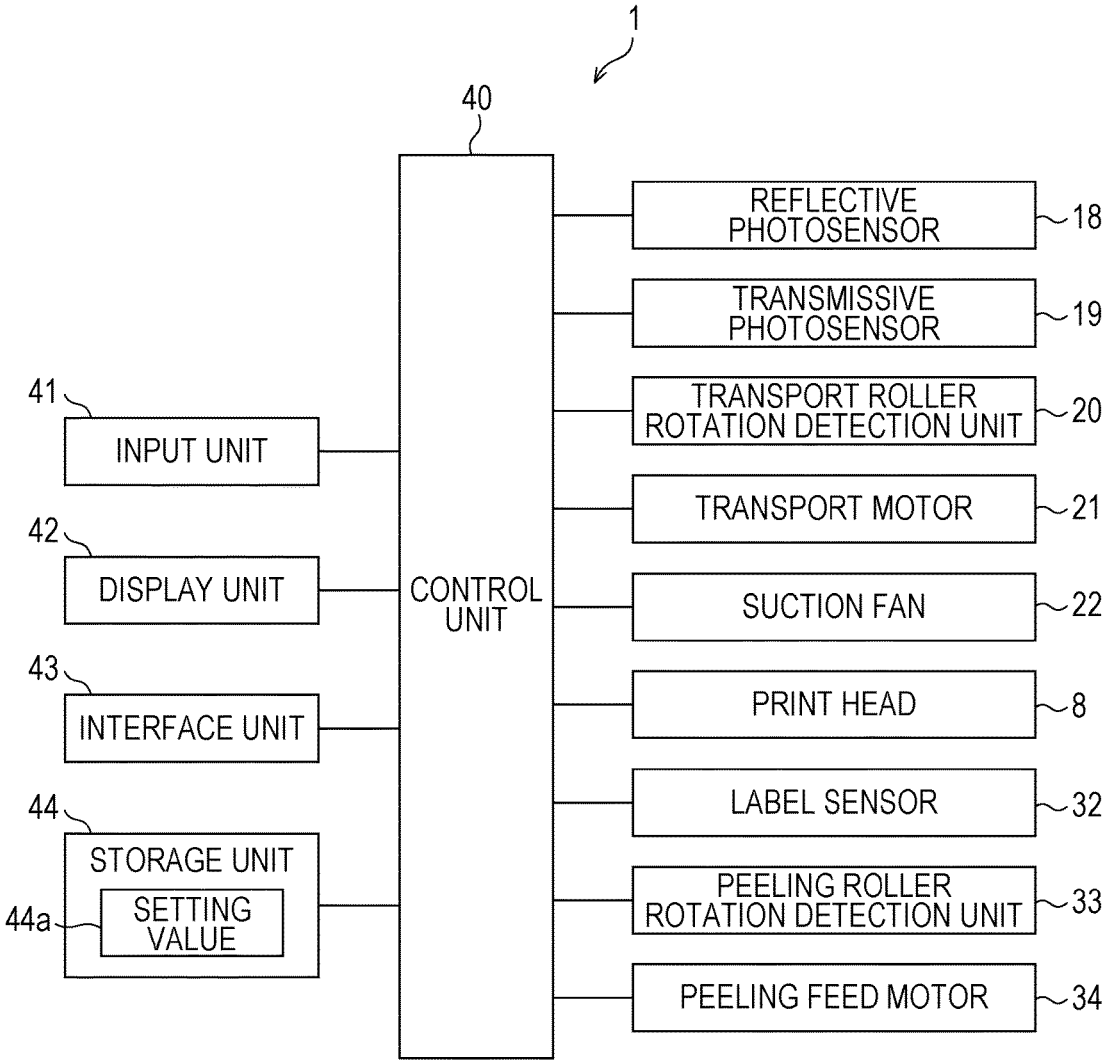
FIG. 3 is a block diagram illustrating a control system of the label printer according to the first embodiment.

As illustrated in FIG. 2, the printing unit 3 includes a roll paper housing portion 29, a feeding roller 10, a transport roller 11, a suction platen 12, a guide 13, and the print head 8. Further, the printing unit 3 includes a reflective photosensor 18, a transmissive photosensor 19 as a paper detection unit (a paper detector), and a transport roller rotation detection unit 20 (a transport roller rotation detector) (FIG. 3). The transport roller 11 constitutes a first transport unit (a first transporter), and the feeding roller 10 and the transport roller 11 may be included in the first transport unit.

The roll paper housing portion 29 is a space for housing the roll paper R, and the label paper P is fed out from the roll paper R set in the roll paper housing portion 29.

The feeding roller 10 is constituted by a pair of rollers arranged opposite to each other, and pulls out the label paper P fed out from the roll paper R and transports it upward.

The transport roller 11 is constituted by a pair of rollers arranged opposite to each other, and pinches the label paper P transported by the feeding roller 10 between the pair of rollers and transports the label paper P toward the print head 8.

The transport roller 11 is connected directly or via a drive gear (not illustrated) or the like to a transport motor 21 (FIG. 3), which will be described later, and is rotated by the power of the transport motor 21. By rotating the transport motor 21 forward and backward, the label printer 1 performs, by the transport roller 11, a forward feeding operation in which the label paper P is transported in a forward direction and a reverse feeding operation in which the label paper P is transported in a reverse direction. Further, the feeding roller 10 is connected to the transport motor 21 together with the transport roller 11, and is driven by the power of the transport motor 21. The feeding roller 10 may have a configuration to be driven by a motor (not illustrated) different from the transport motor 21.

The suction platen 12 is disposed on a downstream side of the transport roller 11 in the transport path of the label paper P. A plurality of air intake holes (not illustrated) are formed on an upper surface (hereinafter, referred to as "platen surface") 12*a* of the suction platen 12 in contact with the label paper P. Each of the air intake holes communicates with a suction fan 22 (FIG. 3). When the suction fan 22 is operated, the air is sucked from the air intake hole, and the label paper P is adsorbed on the platen surface 12*a*.

The print head 8 is disposed opposite the platen surface 12*a*. The print head 8 has nozzle rows corresponding to one or multiple color inks, and discharges the ink through a nozzle (not illustrated) constituting each nozzle row.

The print head 8 prints a character, an image, or the like on a print surface of the label Pb located on the platen surface 12*a* by ejecting the ink based on the print data received from the host computer (not illustrated). It is to be noted that the print head 8 may be configured to perform full-color printing by ejecting inks of four colors of CMYK (cyan, magenta, yellow, or black) or inks of multiple colors obtained by adding specific color inks to the four colors. Alternatively, the print head 8 may be one for performing monochrome printing or two-color printing. The label paper P on which printing is performed by the print head 8 is transported to the peeling unit 4 by the transport roller 11.

The guide 13 is arranged on a downstream side of the print head 8. The guide 13 supports the label paper P on which printing is performed by the print head 8 from below, between the suction platen 12 and the front surface of the printing unit 3. The label paper P passes through over the guide 13 and is transported toward the peeling unit 4.

The reflective photosensor 18 is an optical sensor that detects the black mark provided on the back surface of the mount Pa. The label printer 1 detects that the black mark disposed on the back surface of the mount Pa has reached the position of the reflective photosensor 18 based on the detection value or the change in the detection value of the reflective photosensor 18 by a control unit 40 (FIG. 3) described later. The reflective photosensor 18 is disposed on a downstream side of the roll paper housing portion 29 and on an upstream side of the transport roller 11 in the transport path of the label paper P.

The transmissive photosensor 19 is an optical sensor which is installed in the transport path of the label paper P and detects the presence or absence of the label paper P. The label printer 1 detects that the leading end or a rear end (terminating end) of the label paper P has passed the position of the transmissive photosensor 19 based on the detection value or the change in the detection value of the transmissive photosensor 19 by the control unit 40 (FIG. 3) described later.

The transmissive photosensor 19 is disposed on the downstream side of the roll paper housing portion 29 and on the upstream side of the transport roller 11 in the transport path of the label paper P together with the reflective photosensor 18. More specifically, the transmissive photosensor 19 is positioned on an upstream side of the reflective photosensor 18.

The transport roller rotation detection unit 20 is a sensor that detects the rotation of the transport roller 11, and is configured using, for example, a rotary encoder or a resolver. The transport roller rotation detection unit 20 is attached to, for example, the transport roller 11 and detects the rotation of the transport roller 11. Further, the transport roller rotation detection unit 20 may be configured to detect the rotation of the transport motor 21 (FIG. 3).

The peeling unit 4 includes a peeling member 30, a peeling roller 31 as a second transport unit (a second transporter), a label sensor 32, and a peeling roller rotation detection unit 33 (a peeler roller rotation detector) (FIG. 3).

The peeling member 30 is located downstream of the print head 8 of the printing unit 3 and has a guide surface 30*a* for supporting the label paper P from below and an acute peeling edge 30*b* formed at the leading end of the guide surface 30*a*. The peeling member 30 is disposed close to the front surface of the printing unit 3, and the label paper P guided by the guide 13 is transported onto the guide surface 30*a* of the peeling member 30.

The peeling roller 31 is constituted by a pair of rollers arranged opposite to each other, and pinches the mount Pa between the pair of rollers and transports it. The peeling roller 31 is connected directly or via a drive gear (not illustrated) or the like to a peeling feed motor 34, which will be described later, and is rotated by the power of the peeling feed motor 34.

When the label printer 1 is operated in the peeling mode, the user performs an operation for pinching the mount Pa of the label paper P between the rollers of the peeling roller 31 before starting the printing. The peeling roller 31 is disposed below the peeling member 30 and transports the mount Pa downward while pinching the mount Pa between the rollers thereof.

The mount Pa of the label paper P transported on the guide surface 30*a* is bent at the peeling edge 30*b* and pulled downward by the peeling roller 31. Due to the tensile force of the peeling roller 31, the label Pb is lifted from the mount Pa at the peeling edge 30*b* and is peeled off.

As described above, the peeled label Pb protrudes outside the paper discharge port 4*a*. Further, the mount Pa is discharged below the peeling roller 31 by the peeling roller 31.

On the other hand, when the label printer 1 is operated in the normal printing mode, the peeling roller 31 is not used. In this case, the label Pb on which printing is performed by the printing unit 3 is transported along the guide surface 30*a* together with the mount Pa, and is discharged from the paper discharge port 4*a* in a state where the label Pb is affixed to the mount Pa.

The label sensor 32 is disposed in the vicinity of the peeling edge 30*b* of the peeling member 30. The label sensor 32 is a sensor which detects the presence or absence of the label Pb at a detection position between the peeling edge 30*b* and the paper discharge port 4*a*, and is constituted by, for example, a transmissive photosensor. Based on the detection value or the change in the detection value of the label sensor 32, the control unit 40, which will be described later, determines the presence or absence of the label Pb that is peeled off by the peeling member 30 and protrudes from the paper discharge port 4*a*.

The peeling roller rotation detection unit 33 is a sensor that detects the rotation of the peeling roller 31, and includes, for example, a rotary encoder or a resolver. The peeling roller rotation detection unit 33 is attached to, for example, the peeling roller 31, and detects the rotation of the peeling roller 31. Further, the peeling roller rotation detection unit 33 may be configured to detect the rotation of the peeling feed motor 34 (FIG. 3).

FIG. 3 is a block diagram illustrating a control system of the label printer 1.

The label printer 1 includes the control unit 40 that controls each of the printing unit 3 and the peeling unit 4. The control unit 40 includes a processor (not illustrated) such as a Central Processing Unit (CPU) or a microcomputer, or the like and controls each unit of the label printer 1 by executing a program by the processor. In addition to the processor, the control unit 40 includes a Random Access Memory (RAM), a Read Only Memory (ROM), and the like. By executing the program by the processor, the control unit 40 realizes various functions to be described later by cooperation of hardware and software. Further, the control unit 40 may be hardware programmed to execute a function to be described later. The RAM forms a work area for temporarily storing programs executed by the processor, data to be processed, and the like. The ROM stores data including basic control programs executed by the processor, various setting values, or the like in a nonvolatile manner.

The label printer 1 includes an input unit 41, a display unit 42, an interface unit 43, and a storage unit 44 (memory), and these units are connected to the control unit 40.

Further, the reflective photosensor 18, the transmissive photosensor 19, the transport roller rotation detection unit 20, the label sensor 32, and the peeling roller rotation detection unit 33 are connected to the control unit 40. These sensors may be connected to the control unit 40 via a sensor driving element such as a gate array (not illustrated). The control unit 40 acquires the detection results of these sensors.

Further, the print head 8, the transport motor 21, the suction fan 22, and the peeling feed motor 34 are connected to the control unit 40 as operation sections to be controlled. The transport motor 21, the suction fan 22, the print head 8, and the peeling feed motor 34 may each be connected to the control unit 40 via a drive circuit that outputs power for driving. The control unit 40 controls each of these operation sections to carry out transport and printing of the label paper P.

The input unit 41 detects an operation on the operation button 15, and outputs an operation signal corresponding to the content of the detected operation to the control unit 40.

In accordance with the control of the control unit 40, the display unit 42 drives the display 16 and the lamp 17, causes the display 16 to display characters and images, and causes the lamp 17 to be turned on or flashed.

The interface unit 43 is connected to the host computer (not illustrated) and communicates with the host computer under the control of the control unit 40. The interface unit 43 receives the command and the print data transmitted by the host computer, and outputs the received command and print data to the control unit 40. The interface unit 43 may include a wired communication interface such as Ethernet (registered trademark) or a wireless communication interface such as a wireless LAN (including WiFi (registered trademark)) or Bluetooth (registered trademark). Further, the interface unit 43 may have a configuration to be connected to the host computer using a Universal Serial Bus (USB) cable or the like.

The control unit 40 temporarily stores the command and data received from the host computer through the interface unit 43 in a reception buffer (not illustrated). The control unit 40 sequentially reads and executes the command and data stored in the reception buffer.

The storage unit 44 is configured of a semiconductor memory element and a magnetic storage device, and stores various kinds of data processed by the control unit 40.

For example, the storage unit 44 stores a setting value 44*a*. The setting value 44*a* is a value indicating a setting state relating to the operation of the label printer 1, and specifically indicates an operation mode executed by the label printer 1. The storage unit 44 may have a storage area corresponding to the setting value 44*a*, and may function as a memory switch capable of changing a value stored in the storage area. The setting value 44*a* can be set and changed according to an operation by the operation button 15 or the command transmitted by the host computer.

The control unit 40 refers to the setting value 44*a* stored in the storage unit 44 and executes an operation in an operation mode indicated by the setting value 44*a*.

On the basis of the command and print data received from the host computer, the control unit 40 controls the transport motor 21, the suction fan 22, the print head 8, and the peeling feed motor 34 to perform printing on the label paper P.

When performing printing by the print head 8, the control unit 40 drives the transport motor 21 to rotate the feeding roller 10 and the transport roller 11. A transport speed at which the feeding roller 10 and the transport roller 11 transport the label paper P is set at a predetermined speed (hereinafter, referred to as a first target transport speed) suitable for printing in the print head 8, and the control unit 40 adjusts the transport speed of the label paper P during printing to the first target transport speed. Specifically, the control unit 40 obtains an actual rotation speed of the transport roller 11 based on a detection value of the transport roller rotation detection unit 20, and controls the transport motor 21 so that the obtained actual rotation speed becomes a rotation speed corresponding to the first target transport speed.

The control unit 40 drives the suction fan 22 to adsorb the label paper P by the suction platen 12.

Further, the control unit 40 sequentially reads out the print data from the reception buffer, drives the print head 8 based on the read print data, and executes a print job. The print job refers to a unit of printing operations indicated by the command received from the host computer, and specifically refers to a series of operations of printing a character and an image based on the print data received with the command on the labels Pb the number of which is designated by the command.

When the printing operations included in the print job is completed, the control unit 40 stops each of the transport motor 21, the suction fan 22, and the print head 8, and ends the printing.

In the normal printing mode, as described above, the control unit 40 continuously transports the label paper P by the transport roller 11, and continuously performs printing on the labels Pb the number of which is specified by the command.

In the peeling mode, the control unit 40 drives the transport motor 21 and the peeling feed motor 34 to perform printing by the print head 8 while transporting the label paper P. Based on the detection value of the label sensor 32, the control unit 40 detects that the label Pb on which printing is performed by the print head 8 protrudes from the peeling member 30. When the label Pb is detected by the label sensor 32, the control unit 40 stops the transport by the transport motor 21 and the peeling feed motor 34, and temporarily stops the print head 8. The control unit 40 waits until the user removes the label Pb from the paper discharge port 4*a*. Upon detecting that the detection value of the label sensor 32 has changed due to the user's removal of the label Pb, the control unit 40 resumes the operation of the transport motor 21, the peeling feed motor 34, and the print head 8.

In addition, during execution of the print job, the control unit 40 determines whether or not the rear end of the label paper P being transported has been detected by the transmissive photosensor 19 based on a change in the detection value or the detection value of the transmissive photosensor 19. When it is determined that the rear end of the label paper P has been detected, the control unit 40 determines that the label paper P has run out, and outputs an out-of-paper error. Specifically, the control unit 40 executes a display indicating the out-of-paper error by the display unit 42, and notifies the user of the out-of-paper. Further, the control unit 40 outputs control data indicating an error occurrence from the interface unit 43 to the host computer.

When the rear end of the label paper P is detected in the normal printing mode, the control unit 40 performs transport by the transport roller 11 until the rear end of the label paper P comes off from the transport roller 11. After the rear end of the label paper P comes off from the transport roller 11, the control unit 40 stops the transport motor 21. A timing at which the transport motor 21 is stopped can be determined based on a distance from the transmissive photosensor 19 to the transport roller 11 and a transport speed of the transport roller 11. The control unit 40 stops the transport motor 21 and outputs the out-of-paper error.

Therefore, when the out-of-paper error is output, the label paper P comes off from the transport roller 11 and is in a state of not being restrained. For example, when the user pulls the label paper P protruding outside the paper discharge port 4*a*, the label paper P can be easily removed from the label printer 1, and a new label paper P can be replenished to the label printer 1.

The user sets a new roll paper R in the roll paper housing portion 29 and performs an operation for releasing the out-of-paper error. For example, when the user performs an error release operation using the operation button 15, the out-of-paper error is canceled. Also, the user may operate the host computer to send a release command from the host computer to the label printer 1 to release the out-of-paper error. When the out-of-paper error is released, the control unit 40 controls the transport motor 21, the suction fan 22, and the print head 8 to resume the print job.

When the rear end of the label paper P is detected in the peeling mode, the control unit 40 continues to print on the label Pb while transporting the label paper P by the transport roller 11 and the peeling roller 31. Thus, printing is performed on the label Pb located near the rear end of the label paper P. During this printing, even if the rear end of the label paper P comes off from the transport roller 11, the peeling roller 31 transports the mount Pa, and thus the transport and the printing of the label paper P are continued. Further, since the label paper P is sucked by the suction platen 12 during transport, an effect of stabilizing the transport state of the label paper P can be expected.

Further, when the rear end of the label paper P is detected in the peeling mode, the control unit 40 changes the transport speed of the label paper P to a second target transport speed lower than the first target transport speed. The control unit 40 adjusts the rotation speed of the transport motor 21 and the peeling feed motor 34 to a speed corresponding to the second target transport speed. By transporting the label paper P at a low speed, after the label paper P comes off from the transport roller 11, the disturbance of the transport state of the label paper P is prevented, and the deterioration of the printing quality can be prevented. Further, it is possible to prevent the position of the label paper P from being disturbed when the rear end of the label paper P comes off from the transport roller 11.

After changing the transport speed to the second target transport speed, the control unit 40 determines whether or not the label Pb has reached the detection position of the label sensor 32 based on the detection value of the label sensor 32. More specifically, the control unit 40 determines whether or not the label Pb located in the vicinity of the rear end of the label paper P has been transported to the detection position of the label sensor 32 after printing.

When the label Pb is detected by the label sensor 32, it means that the label Pb on which printing is performed by the print head 8 after the rear end of the label paper P has been detected can be taken out at the paper discharge port 4*a*. In this case, the control unit 40 outputs the out-of-paper error, stops driving the suction fan 22, the print head 8, and the peeling feed motor 34, and waits until the error is released. When the error is released, the control unit 40 resumes the print job.

Figure 4:
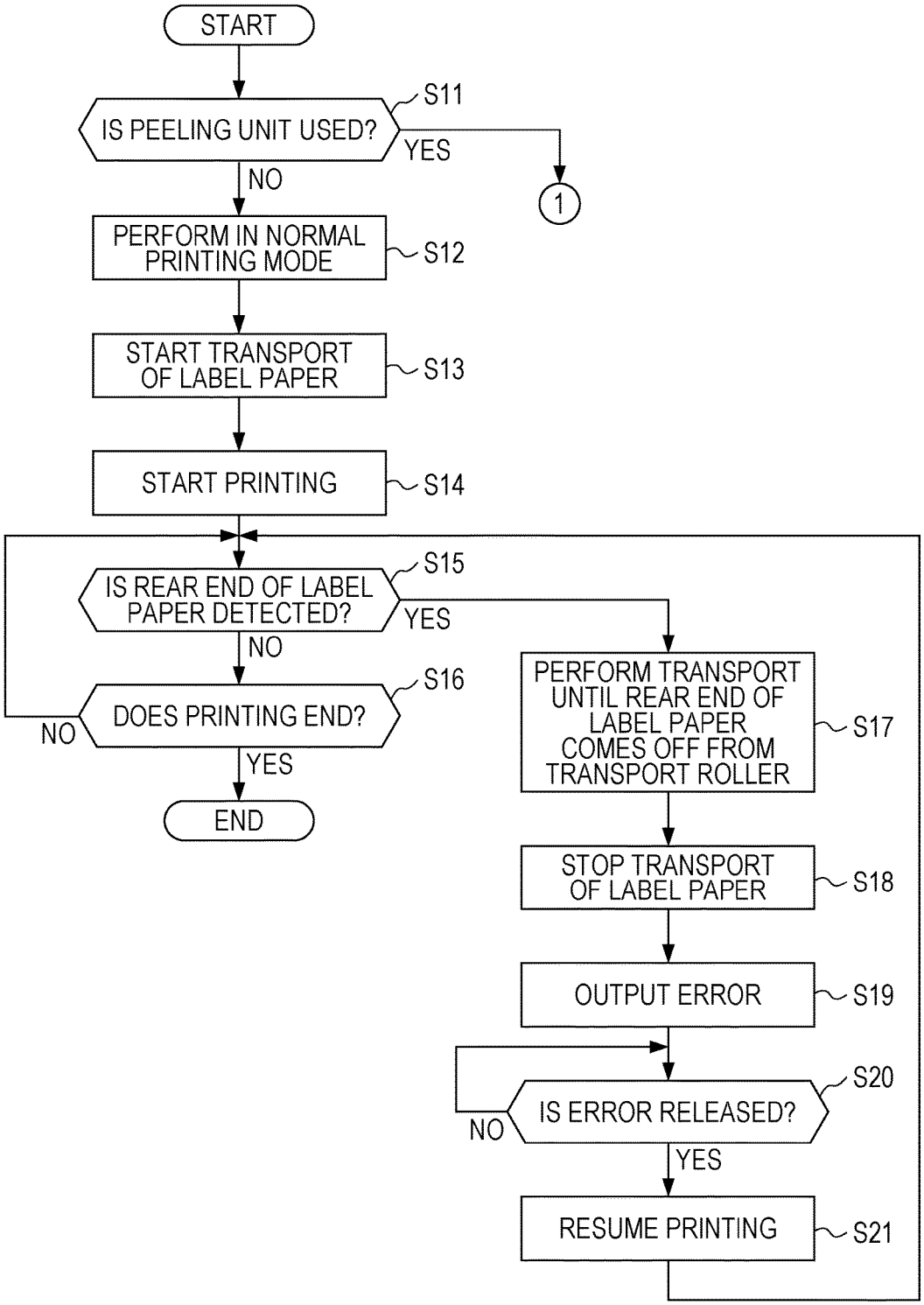
FIG. 4 is a flowchart illustrating an operation of the label printer.
Figure 5:
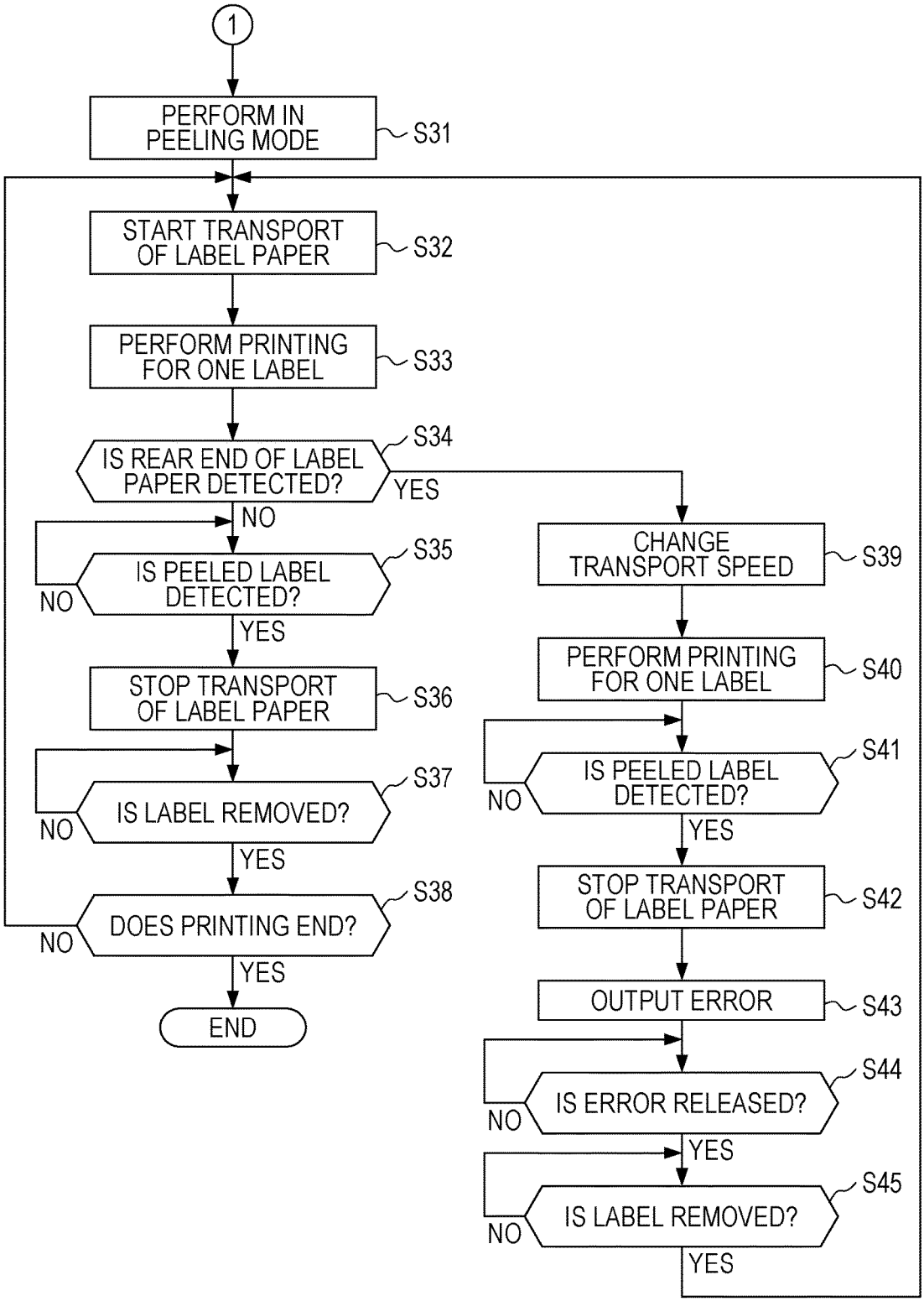
FIG. 5 is a flowchart illustrating an operation of the label printer.

FIG. 4 and FIG. 5 are flowcharts illustrating the operation of the label printer 1.

When starting the print job based on the command and the print data received from the host computer, the control unit 40 determines whether or not to use the peeling unit 4 at the time of printing (Step S11). The case where the peeling unit 4 is used is a case where the peeling unit 4 carries out a process for peeling the label Pb from the mount Pa.

The label printer 1 according to the first embodiment determines whether or not to use the peeling unit 4 by referring to the state of the memory switch, that is, the setting value 44*a* stored in the storage unit 44.

When it is determined that the peeling unit 4 is not used (Step S11; NO), the control unit 40 starts the print job in the normal printing mode (Step S12).

The control unit 40 drives the transport motor 21 to start the transport of the label paper P (Step S13). In addition, in Step S13, the control unit 40 starts driving the suction fan 22. In addition, in Step S13, the control unit 40 starts acquiring the detection values of the reflective photosensor 18 and the transmissive photosensor 19.

The control unit 40 starts the print job and drives the print head 8 based on the print data in accordance with the detection timing of the black mark detected by the reflective photosensor 18 (Step S14). The control unit 40 continuously performs printing on the labels Pb the number of which is specified by the command, and the label Pb after printing is discharged from the paper discharge port 4*a*.

During execution of the print job, the control unit 40 determines whether or not the rear end of the label paper P has been detected based on the detection value of the transmissive photosensor 19 (Step S15).

When it is determined that the rear end of the label paper P has not been detected (Step S15; NO), the control unit 40 determines whether or not the print job has ended (Step S16). When it is determined that the print job has not ended (Step S16; NO), the control unit 40 continues the print job and returns to Step S15 to perform the determination again. A period for performing the determination in Step S15 is set in advance.

On the other hand, when it is determined that the print job has ended (Step S16; YES), the control unit 40 stops all of the drive of the transport motor 21, the suction fan 22, and the print head 8, and ends this process.

When it is determined that the rear end of the label paper P has been detected by the transmissive photosensor 19 (Step S15; YES), the control unit 40 performs transport by the transport roller 11 until the rear end of the label paper P comes off from the transport roller 11 (Step S17). The control unit 40 stops the drive of the transport motor 21 and stops the transport roller 11 (Step S18). In addition, in Step S18, the control unit 40 stops driving the print head 8 and the suction fan 22.

The control unit 40 outputs the error indicating that the label paper P runs out (Step S19), and waits until the error is released (Step S20). Here, the label paper P is taken out by the user, and the new label paper P is set in the roll paper housing portion 29.

When it is detected that the user has performed the error release operation (Step S20; YES), the control unit 40 resumes the print job (Step S21). In other words, the control unit 40 drives the transport motor 21, the print head 8, and the suction fan 22, resumes the interrupted printing, and moves to Step S15.

On the other hand, when it is determined that the peeling unit 4 is used (Step S11; YES), the control unit 40 starts the print job in the peeling mode (Step S31).

The control unit 40 drives the transport motor 21 and the peeling feed motor 34 to start the transport of the label paper P (Step S32). In addition, in Step S32, the control unit 40 starts driving the suction fan 22 and starts acquiring the detection values of the reflective photosensor 18 and the transmissive photosensor 19.

In response to the detection timing of the black mark detected by the reflective photosensor 18, the control unit 40 drives the print head 8 to perform printing on the one label Pb (Step S33). As the label paper P is transported, the label Pb on which printing is performed is transported to the peeling unit 4 and is peeled from the mount Pa.

During execution of the print job, the control unit 40 determines whether or not the rear end of the label paper P has been detected based on the detection value of the transmissive photosensor 19 (Step S34).

When it is determined that the rear end of the label paper P has not been detected (Step S34; NO), the control unit 40 determines whether or not the label Pb on which printing is performed has been detected by the label sensor 32 based on the detection value of the label sensor 32 (Step S35). When the label Pb on which printing is performed has not been detected by the label sensor 32 (Step S35; NO), the control unit 40 continues the transport of the label paper P and stands by. When the label Pb is detected by the label sensor 32 (Step S35; YES), the control unit 40 stops the transport motor 21 and the peeling feed motor 34, and stops the transport of the label paper P (Step S36).

On the basis of the detection value of the label sensor 32, the control unit 40 determines whether or not the label Pb has been removed from the paper discharge port 4*a* (Step S37), and stands by during the label Pb not being removed (Step S37; NO). When it is determined that the label Pb has been removed from the paper discharge port 4*a* (Step S37; YES), the control unit 40 determines whether or not the print job has ended (Step S38). When it is determined that the print job has not ended (Step S38; NO), the control unit 40 continues the print job and returns to Step S32 to perform printing on the next label Pb.

On the other hand, when it is determined that the print job has ended (Step S38; YES), the control unit 40 stops all of the drive of the transport motor 21, the peeling feed motor 34, the suction fan 22, and the print head 8, and ends this process.

When it is determined that the rear end of the label paper P is detected by the transmissive photosensor 19 (Step S34; YES), the control unit 40 adjusts the transport speed of the label paper P (Step S39). Specifically, the control unit 40 adjusts the rotation speed of the transport motor 21 and the peeling feed motor 34 to change the transport speed of the label paper P to the second target transport speed. Further, the control unit 40 performs printing on the label Pb for one sheet (Step S40). Here, the label Pb to be subjected to printing is the label Pb located in the vicinity of the rear end of the label paper P.

The control unit 40 determines whether or not the label Pb on which printing is performed has been detected by the label sensor 32 based on the detection value of the label sensor 32 (Step S41). When the label Pb is not detected by the label sensor 32 (Step S41; NO), the control unit 40 continues the transport of the label paper P and monitors the detection value of the label sensor 32. When the label Pb is detected by the label sensor 32 (Step S41; YES), the control unit 40 stops the transport motor 21 and the peeling feed motor 34, and stops the transport of the label paper P (Step S42).

After the label Pb is detected by the label sensor 32, the control unit 40 outputs the error indicating that the label paper P runs out (Step S43), and stands by until the error is released (Step S44). Here, the label paper P is taken out by the user, and the new label paper P is set in the roll paper housing portion 29. When it is detected that the user has performed the error release operation (Step S44; YES), the control unit 40 determines whether or not the label Pb is removed from the paper discharge port 4*a* based on the detection value of the label sensor 32 (Step S45). Note that, after the label Pb is removed from the paper discharge port 4*a*, the control unit 40 may output the error indicating that the label paper P runs out, and may stand by for the new label paper P to be set in the roll paper housing portion 29.

While the label Pb is not removed (Step S45; NO), the control unit 40 stands by. When the label Pb is removed from the paper discharge port 4*a* (Step S45; YES), the control unit 40 moves to Step S32 and executes printing on the next label Pb.

As described above, the label printer 1 according to the first embodiment to which the invention is applied includes the print head 8 which prints on the label paper P with the label Pb affixed to the mount Pa. The label printer 1 is disposed on the upstream side of the print head 8 in the transport path of the label paper P and includes the transport roller 11 that transports the label paper P. Further, the transmissive photosensor 19 for detecting the rear end of the label paper P is provided on the upstream side of the transport roller 11 in the transport path of the label paper P. The label printer 1 includes the control unit 40 for controlling the print head 8 and the transport roller 11, and is configured to be capable of using the peeling unit 4 for peeling the label Pb from the mount Pa, with the peeling roller 31 for transporting the mount Pa. In the normal printing mode in which the peeling unit 4 is not used, when the rear end of the label paper P is detected by the transmissive photosensor 19, the control unit 40 stops the transport by the transport roller 11 when the rear end of the label paper P comes off from the transport roller 11. In the peeling mode in which the peeling unit 4 is used, when the rear end of the label paper P is detected by the transmissive photosensor 19, the control unit 40 causes the peeling roller 31 to transport the mount Pa after the rear end of the label paper P comes off from the transport roller 11.

According to the label printer 1 to which the printing apparatus and the control method of the printing apparatus according to the invention are applied, when the rear end of the label paper P is detected, the label paper P is transported until the rear end of the label paper P comes off from the transport roller 11 when the peeling unit 4 is not used. Further, when the peeling unit 4 is used, the mount Pa is transported by the peeling roller 31 of the peeling unit 4 even after coming off from the transport roller 11. Therefore, when the peeling unit 4 is used, it is possible to print on the label Pb in the vicinity of the rear end of the label paper P while transporting the label paper P by the peeling roller 31, and to effectively use the label Pb. In addition, when the peeling unit 4 is not used, the label paper P comes off from the transport roller 11, thereby making it possible to facilitate the replacement work and improve the operation efficiency.

Further, the label printer 1 includes the suction platen 12 that causes the platen surface 12*a* facing the print head 8 to adsorb the label paper P. In the peeling mode, after the rear end of the label paper P is detected by the transmissive photosensor 19, the control unit 40 causes the peeling roller 31 to transport the label paper P along the platen surface 12*a*, and causes the print head 8 to print on the label Pb. Thus, when the label paper P is transported by the peeling roller 31 after the rear end of the label paper P comes off from the transport roller 11, the label paper P can be stabilized by the suction platen 12. Therefore, it is possible to reliably print on the label Pb in the vicinity of the rear end of the label paper P and to effectively use the label Pb.

Further, in the peeling mode, when printing on the label Pb by the print head 8 after the rear end of the label paper P comes off from the transport roller 11, the control unit 40 adjusts the transport speed of the peeling roller 31. Specifically, the transport speed by the peeling roller 31 is set to the second target transport speed which is lower than the first target transport speed which is the transport speed by the transport roller 11 when printing is performed on the label Pb by the print head 8 in the normal printing mode. Thus, after the rear end of the label paper P comes off from the transport roller 11, the label paper P can be stably transported by the peeling roller 31.

In addition, in the normal printing mode, when the rear end of the label paper P is detected by the transmissive photosensor 19, the control unit 40 performs printing on the last label Pb by the print head 8 and then discharges the label paper P by the transport roller 11. Further, the control unit 40 stops the transport by the transport roller 11 thereafter. Thus, the printable last label Pb on the label paper P can be effectively utilized.

Further, the label printer 1 includes the storage unit 44 that stores the setting value 44*a* indicating the setting state of the operation mode to be executed by the control unit 40. The control unit 40 switches between the normal printing mode and the peeling mode based on the setting value 44*a* stored in the storage unit 44. Thus, by storing the setting state in the storage unit 44, the label printer 1 can be operated in an arbitrary operation mode.

Second Embodiment

Next, a label printer 2 according to a second embodiment to which the invention is applied will be described.

Figure 6:
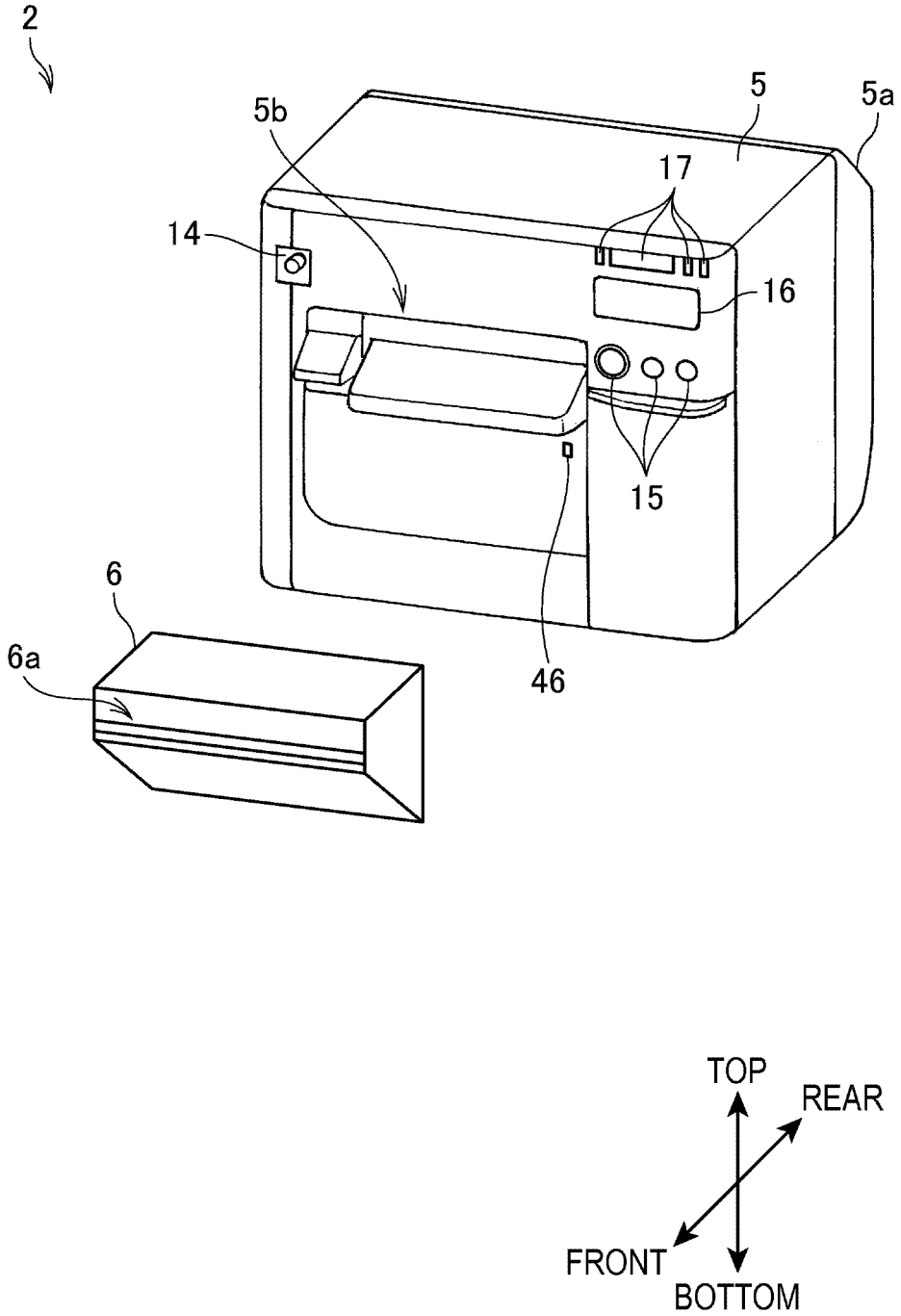
FIG. 6 is an external perspective view of a label printer according to a second embodiment.

FIG. 6 is an external perspective view of the label printer 2 according to the second embodiment. In the second embodiment, identical or corresponding portions to those in the first embodiment will be denoted by the same reference numerals, and redundant description thereof will be omitted.

The label printer 2 includes a printing unit 5 corresponding to the printing unit 3 and a peeling unit 6 corresponding to the peeling unit 4, which are described in the first embodiment. The printing unit 5 is a main body of the label printer 2, and the label printer 2 is configured so that the peeling unit 6 can be detachably attached to the printing unit 5. In other words, an attachment mechanism (not illustrated) is provided on the front surface of a case 5*a* of the printing unit 5 to detachably attach the peeling unit 6.

In the label printer 2, printing can be performed in a state in which the peeling unit 6 is removed from the printing unit 5, that is, by the printing unit 5 alone. Therefore, when the user peels the label Pb from the mount Pa using the peeling unit 6, the user attaches the peeling unit 6 to the printing unit 5, and when the label Pb is not required to be peeled off, the user uses the printing unit 5 without attaching the peeling unit 6 thereto.

The peeling unit 6 is attached to the front surface of the printing unit 5. In a state in which the peeling unit 6 is attached to the printing unit 5, the printing unit 5 transports the label paper P after printing to the peeling unit 6, and the peeling unit 6 peels the label Pb of the label paper P transported from the printing unit 5 from the mount Pa and discharges the label Pb from a paper discharge port 6*a*.

The label printer 2 executes an operation in the normal printing mode in a state where the peeling unit 6 is not attached to the printing unit 5. The operation of the normal printing mode is similar to that of the first embodiment, and the label printer 2 continuously prints on each of the labels Pb placed on the label paper P, and discharges the label paper P with the labels Pb affixed to the mount Pa from a paper discharge port 5*b* formed on the front surface of the printing unit 5.

On the other hand, in a state in which the peeling unit 6 is attached to the printing unit 5, the label printer 2 performs the operation in the peeling mode. The operation in the peeling mode is similar to that of the label printer 1 described in the first embodiment. In other words, the label printer 2 intermittently prints on each label Pb while temporarily stopping the transport of the label paper P, and discharges the label Pb on which printing is performed from the paper discharge port 6*a*.

The printing unit 5 includes a peeling unit attachment sensor 46 as a peeling unit detection unit (a peeler detector). The peeling unit attachment sensor 46 is disposed on the front surface of the printing unit 5, and is a sensor whose output changes between a state in which the peeling unit 6 is attached to the printing unit 5 and a state in which the peeling unit 6 is not attached. The peeling unit attachment sensor 46 is constituted by, for example, a switch type sensor.

The printing unit 5 has the same internal configuration as that of the printing unit 3 illustrated in FIG. 2, and includes the feeding roller 10 and the transport roller 11 which transport the label paper P housed in the roll paper housing portion 29, the suction platen 12, and the print head 8 for printing on the label paper P. Further, the printing unit 5 includes the transmissive photosensor 19 for detecting the rear end of the label paper P and the reflective photosensor 18 for detecting the black mark of the label paper P. The configuration of the guide 13 and the like is also similar to that of the printing unit 3.

Figure 7:
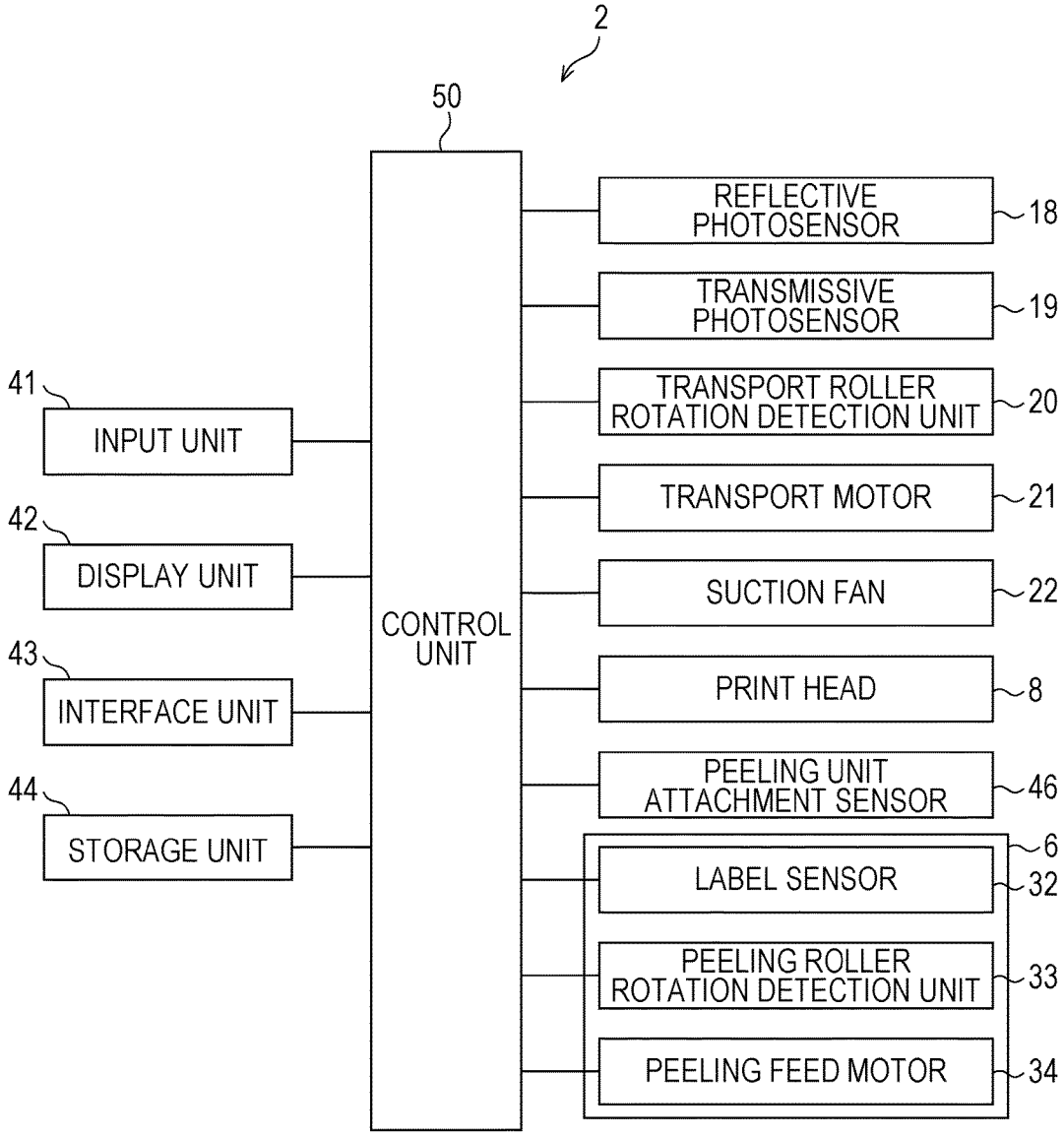
FIG. 7 is a block diagram illustrating a control system of the label printer according to the second embodiment.

The peeling unit 6 has the same internal configuration as that of the peeling unit 4 illustrated in FIG. 2, and includes the peeling member 30, the peeling roller 31, the label sensor 32, and the peeling roller rotation detection unit 33 (FIG. 7).

FIG. 7 is a block diagram illustrating a control system of the label printer 2.

The label printer 2 includes a control unit 50 that controls each of the printing unit 5 and the peeling unit 6.

The control unit 50 includes a processor (not illustrated) such as a CPU or a microcomputer, and controls each unit of the label printer 2 by executing a program by the processor. In addition to the processor, the control unit 50 includes a RAM, a ROM, and the like. By executing the program by the processor, the control unit 50 realizes various functions to be described later by cooperation of hardware and software. Further, the control unit 50 may be hardware programmed to execute a function to be described later. The RAM forms a work area for temporarily storing programs executed by the processor, data to be processed, and the like. The ROM stores data including basic control programs executed by the processor, various setting values, or the like in a nonvolatile manner.

Similarly to the control unit 40, the control unit 50 is connected to the input unit 41, the display unit 42, the interface unit 43, and the storage unit 44. Each of the reflective photosensor 18, the transmissive photosensor 19, the transport roller rotation detection unit 20, the transport motor 21, the suction fan 22, and the print head 8 is connected to the control unit 50. The configuration of each of these units is similar to that of the first embodiment as described above.

Further, the label sensor 32, the peeling roller rotation detection unit 33, and the peeling feed motor 34 are connected to the control unit 50. The configuration of each of these units is also similar to that of the first embodiment. The label sensor 32, the peeling roller rotation detection unit 33, and the peeling feed motor 34 are disposed in the peeling unit 6 separated from the printing unit 5.

Further, the peeling unit attachment sensor 46 is connected to the control unit 50. The control unit 50 can determine whether or not the peeling unit 6 is attached to the printing unit 5 based on the detection value of the peeling unit attachment sensor 46.

The control unit 50 operates in the same manner as the control unit 40 described with reference to the flowcharts of FIGS. 4 and 5. In step S11 of FIG. 4, the control unit 50 determines whether or not the peeling unit 6 is attached to the printing unit 5 based on the detection value of the peeling unit attachment sensor 46, and when the peeling unit 6 is attached, it is determined that the peeling unit 6 is used (Step S11; YES). In this case, the control unit 50 executes an operation in the peeling mode similarly to the control unit 40. On the other hand, when the peeling unit 6 is not attached, it is determined that the peeling unit 6 is not used (Step S11; NO). In this case, the control unit 50 executes an operation in the normal printing mode similarly to the control unit 40.

As described above, in the label printer 2 according to the second embodiment to which the invention is applied, similarly to the label printer 1 according to the first embodiment, the operation in the normal printing mode or the peeling mode are executed in accordance with whether or not the peeling unit 6 is used, and the same operational effect as that of the label printer 1 can be obtained.

Further, the label printer 2 is configured such that the peeling unit 6 is detachably attached to the printing unit 5, includes the peeling unit attachment sensor 46, and switches between the normal printing mode and the peeling mode based on the detection result by the peeling unit attachment sensor 46.

Thus, the label printer 2 can be operated in an appropriate operation mode corresponding to the attaching/detaching state of the peeling unit 6 to/from the printing unit 5. For example, it is not necessary for the user to set in advance whether to execute the operation in the peeling mode using the peeling unit 6 or to execute the operation in the normal printing mode without using the peeling unit 6. In other words, it is possible to omit the setting for the operation mode of the operation to be executed by the label printer 2 by the operation of attaching or detaching the peeling unit 6 in accordance with the necessity. Accordingly, it is possible to further enhance the operability of the label printer 2 which can use the peeling unit 6.

Note that, each of the above embodiments represents a specific example to which the invention is applied, and the invention is not limited thereto.

For example, in each of the above embodiments, described is the configuration in which, when the control unit 40 detects that the rear end of the label paper P has come off from the transport roller 11, the transport speed of the label paper P is changed to the second target transport speed that is lower than the first target transport speed. The invention is not limited to this, and the configuration may be such that, for example, when the control unit 40 detects that the rear end of the label paper P has come off from the transport roller 11, the transport speed of the label paper P is not changed.

In addition, in each of the above embodiments, an ink jet printer is exemplified as an example to which the printing apparatus according to the invention is applied; however, the invention is not limited thereto and may be applied to a printer of another type such as a thermal printer or a dot impact printer. Further, the invention is applicable to various printers incorporated in other apparatuses.

Further, in each of the above embodiments, described is the configuration in which the program executed by the CPU of the control units 40 and 50 is stored in the storage unit 44 included in the label printers 1 and 2. The invention is not limited thereto, and the configuration may be such that the program may be stored in another storage device or storage medium other than the storage unit 44, or a storage device or a storage medium included in a device which is different from the label printers 1 and 2, and read and executed by the control units 40 and 50.

What is claimed is:

1. A printing apparatus comprising:

a print head configured to print on a label paper with a label affixed to a mount;

a first transporter configured to transport the label paper on an upstream side of the print head in a transport path of the label paper and;

a paper detector configured to detect a rear end of the label paper on an upstream side of the first transporter in the transport path of the label paper; and a processor configured to control the print head and the first transporter, a peeler configured to peel the label from the mount and include a second transporter transporting the mount, wherein the processor causes the first transporter to stop transport when the rear end of the label paper comes off from the first transporter in a case where the paper detector detects the rear end of the label paper in a normal printing mode in which the peeler is not used, and causes the second transporter to transport the mount after the rear end of the label paper comes off from the first transporter in a case where the paper detector detects the rear end of the label paper in a peeling mode in which the peeler is used.

2. The printing apparatus according to claim 1, including a suction platen for adsorbing the label paper on a platen surface facing the print head, wherein the processor causes the second transporter to transport the label paper along the platen surface and causes the print head to print on the label, after the rear end of the label paper is detected by the paper detector in the peeling mode.

3. The printing apparatus according to claim 1, wherein, when printing on the label by the print head after the rear end of the label paper has come off from the first transporter in the peeling mode, the processor makes a transport speed by the second transporter lower than the transport speed by the first transporter when printing on the label by the print head in the normal printing mode.

4. The printing apparatus according to claim 1, wherein, when the rear end of the label paper is detected by the paper detector in the normal printing mode, the processor performs printing on the label that is a last label by the print head, then causes the first transporter to discharge the label paper, and thereafter causes the first transporter to stop transport.

5. The printing apparatus according to claim 1, including a memory that stores a setting state of an operation mode of an operation to be executed by the processor, wherein the processor switches between the normal printing mode and the peeling mode based on the setting state stored in the memory.

6. The printing apparatus according to claim 1, wherein the peeler is configured so as to be detachable from a main body of the printing apparatus, the printing apparatus includes a peeler detector that detects whether or not the peeler is attached to the main body, and the processor switches between the normal printing mode and the peeling mode based on a result of detection by the peeler detector.

7. A control method of a printing apparatus, the printing apparatus including: a print head configured to print on a label paper with a label affixed to a mount; a first transporter configured to transport the label paper on an upstream side of the print head in a transport path of the label paper; and a paper detector configured to detect a rear end of the label paper on an upstream side of the first transporter in the transport path of the label paper, and a peeler configured to peel the label from the mount and include a second transporter transporting the mount, the control method comprising:

stopping transport by the first transporter when the rear end of the label paper comes off from the first transporter in a case where the paper detector detects the rear end of the label paper in a normal printing mode in which the peeler is not used; and transporting the mount by the second transporter after the rear end of the label paper comes off from the first transporter in a case where the paper detector detects the rear end of the label paper in a peeling mode in which the peeler is used.

* * * * *